US005709566A

United States Patent [19]

Tsuji et al.

[11] Patent Number: 5,709,566

[45] Date of Patent: Jan. 20, 1998

[54] PRESS-CONTACT CONNECTOR ASSEMBLY

[75] Inventors: Yoshitsugu Tsuji; Takuya Inoue; Nori Inoue, all of Mie-ken, Japan

[73] Assignee: Sumitomo Wiring Systems, Ltd., Yokkaichi, Japan

[21] Appl. No.: 674,969

[22] Filed: Jul. 3, 1996

Related U.S. Application Data

[60] Continuation of Ser. No. 433,759, May 4, 1995, which is a division of Ser. No. 172,235, Dec. 23, 1993, Pat. No. 5,433,625.

[30] Foreign Application Priority Data

| | | | |
|---|---|---|---|
| Dec. 26, 1992 | [JP] | Japan | 4-93177 U |
| Dec. 26, 1992 | [JP] | Japan | 4-93178 U |
| Dec. 26, 1992 | [JP] | Japan | 4-93179 U |
| Dec. 26, 1992 | [JP] | Japan | 4-93180 U |
| Jan. 6, 1993 | [JP] | Japan | 5-2647 U |
| Jan. 6, 1993 | [JP] | Japan | 5-17011 |

[51] Int. Cl.[6] ..... H01R 4/24

[52] U.S. Cl. ..... 439/397; 439/419; 439/699.2; 439/942

[58] Field of Search ..... 439/699.2, 419, 439/942, 620, 397–400, 918

[56] References Cited

U.S. PATENT DOCUMENTS

| | | | |
|---|---|---|---|
| Re. 34,135 | 12/1992 | Madsen et al. | 439/419 |
| 2,779,842 | 1/1957 | Walker | 200/142 |
| 3,501,736 | 3/1970 | Norris . | |
| 4,040,704 | 8/1977 | Huber . | |
| 4,101,189 | 7/1978 | Moser et al. | 439/405 |
| 4,127,312 | 11/1978 | Fleischhacker et al. . | |
| 4,227,763 | 10/1980 | Marks . | |
| 4,264,117 | 4/1981 | Pritulsky | 439/419 |
| 4,581,820 | 4/1986 | Lahn et al. | 439/404 |
| 4,767,353 | 8/1988 | Hughes et al. | 439/398 |
| 4,820,179 | 4/1989 | Saijo | 439/397 |
| 4,895,531 | 1/1990 | Vignoli | 439/404 |
| 4,941,844 | 7/1990 | Bowden et al. | 439/425 |
| 4,968,267 | 11/1990 | Payne | 439/410 |
| 5,057,033 | 10/1991 | Nadin | 439/397 |
| 5,120,235 | 6/1992 | Kashiwa | 439/405 |

FOREIGN PATENT DOCUMENTS

| | | | |
|---|---|---|---|
| 390450 | 10/1990 | European Pat. Off. . | |
| 2176663 | 8/1988 | United Kingdom | 439/699.2 |
| 2236437 | 4/1991 | United Kingdom . | |

*Primary Examiner*—Hien Vu
*Assistant Examiner*—Brian J. Biggi
*Attorney, Agent, or Firm*—Sughrue, Mion, Zinn, Macpeak & Seas, PLLC

[57] ABSTRACT

A press-contact connector assembly for a socket joint of a lighting fixture includes a press-contact electrode including a box-shaped body, a press-contact blade on one end of the box-shaped body, the press-contact blade having two opposed press-contact portions which extend away from the box-shaped body and form an axial slot therebetween for receiving a cable, and a power supply terminal on the other end of the box-shaped body. The assembly further includes a casing having a hood for receiving a lighting fixture electrode, a cylindrical portion for holding the press-contact electrode so that the power supply terminal contacts with the lighting fixture electrode in the hood, and a guide portion for defining a guide path to introduce the cable into the axial slot of the press-contact blade. The guide portion includes an notch at an upper portion of the cylindrical portion and which forms an inlet into which the cable is introduced, and slant portions formed on opposite sides of the inlet of the notch, the slant portions serving to guide the cable into the axial slot and to retain the cable therein.

1 Claim, 16 Drawing Sheets

PRESS-CONTACT CONNECTOR ASSEMBLY

This is continuation of application No. 08/433,759 filed May 4, 1995, which is a divisional of application Ser. No. 08/172,235 filed Dec. 23, 1993, now U.S. Pat. No. 5,433,625.

BACKGROUND OF THE INVENTION

1. Field of the Invention

This invention relates to a press-contact connector assembly and more particularly to a press-contact connector assembly suitable for an automobile harness.

2. Statement of the Prior Art

For convenience of explanation, a conventional wire harness and a lighting socket joint for an automobile will be described by referring to drawings.

FIG. 22 is a perspective view of a conventional wire harness; FIG. 23 is a plan view of a conventional wire harness, illustrating an example of branched electrical cable; FIG. 24 is a perspective view of the branched electrical cable; FIG. 25 is a perspective view of a conventional socket joint for a lighting fixture, illustrating a connection between the Joint and the harness; and FIG. 26 is a perspective view of another conventional socket joint for a lighting fixture, illustrating a connection between the joint and the harness.

As shown in FIGS. 22 and 23, in a lighting fixture harness 1 for an automobile, it is necessary to branch a single cable into a plurality of wires in order to turn a plurality of lights on and off. FIG. 24 shows a general branched harness. An electrical cable 2 to serve as a main line is stripped of its sheath at an intermediate portion while an electrical cable 3 to serve as a branched line is stripped of its sheath at an end portion. Exposed conductors of the cables 2 and 3 are coupled to each other by means of a metal clamp 4 and insulated with a tape. In order to prevent the branched portions from shorting, each branched portion is shifted by a small distance on a single harness. After forming the branched cable, a plurality of cables are bundled together by means of tape. Connectors not shown are connected to the end of the cable 3 to be branched.

The prior harness described above requires a number of forming process such as sheath-stripping, clamp-pressing, and tape-winding upon branching the electrical cable and shifting upon stripping the sheath, and further connector-coupling at the branched end.

There is also known as a method of branching a cable a method wherein a metal member is provided with a press-contact slot and accommodated in a plastic case together with an electrical cable for press-contact joining to thereby enable branching. However, even if the electrical cable is branched by a press-contact process, it is impossible to eliminate a process of press-contacting a connector terminal with the cable. Further, the cost of the press-contact Joint connector is high.

On the other hand, a connector may be press-contacted to an intermediate portion of an electrical cable so as to parallelly connect a plurality of base plates to a common base in a computer device. In the case that such a connection is applied to a harness for an automobile, branched lines project from the harness, since the branched lines vertically extend from a main line. This connection cannot be used in the automobile harness in view of its space, since it must be arranged in a narrow space generally.

Since the branched line will swing and thus be unstable, it generate noise when it hits a car body under vibration.

As the prior press-contact connector is connected to and supported by an electronic circuit base plate, it is not necessary to provide a holder which secures the connector itself to a frame. Accordingly, the prior press-contact connector must be secured to a car body by another coupler if it is used in a car harness. In this case, it is not impossible to connect the coupler to a connector body. However, the connector body will contact with the car body and a cable is arranged on the connector body since the cable is press-contacted to the rear face of the connector body. This results in difficulty in coupling a pair of connectors.

In particular, the cable to be a branched line projects into an interior of an automobile when the cable to be a main line is arranged on a wall of the interior, thereby reducing an effective space in the car interior. A package will rub or hit the projected cable when the package is carried into or out of the car interior. Breakage of the cable may result.

In addition, for example, a lighting fixture for decorating a Christmas tree connects a plurality of electrical lamps to a pair of electrical power supply lines. In this case, it is necessary to branch electrical cables at many positions between the pair of power supply lines to be the main lines to connect electrical sockets to the lines.

Heretofore, measures for making such branched wiring are known as shown in FIGS. 28 and 26.

In FIG. 25, an electrical power supply line 2*a* to be a main line is stripped off a sheath at an intermediate portion, each of leads 3*a* for electrical lamp sockets 2*a* to be a branched line is stripped off a sheath at an end portion, and exposed conductor portions are connected to each other by a metal clamp 4. After connecting them, a vinyl tape 5 covers over the metal portions to insulate them.

On the other hand, in FIG. 26, a terminal 6 is provided at an end with a pair of electrical power supply terminal portions 6*a* to be connected to electrodes of the lighting fixture 8 and at the other end with a crimping portion 6*b* for coupling two cables while a casing 7 is provided to accommodate the electrodes of the lighting fixture 8. The power supply lines 1*a* are cut off, opposite ends 1*a*', 1*a*' are stripped of sheath, and the ends 1*a*', 1*a*' are juxtaposed and connected to each other by the crimping portion 6*b* of the terminal 6. After the lines 1*a* are connected to the pair of terminals 6, the terminals 6 and lighting fixture 8 are inserted into the casing 7.

It is necessary to prepare a special tool since the cables must be connected after stripping them in the prior socket for the lighting fixture. This is a troublesome operation. In particular, the former case requires a stripping process of an intermediate portion of the supply lines.

SUMMARY OF THE INVENTION

An object of the present invention is to provide a press-contact connector assembly which can effectively produce a harness which needs a branched wiring and in which the branched wiring does not project from a main line.

Another object of the present invention is to provide a press-contact connector assembly which can effectively produce a harness which needs a branched wiring and which can fix the position of the branched wiring.

Another object of the present invention is to provide a press-contact connector assembly which can effectively produce a harness which needs a branched wiring and which can easily effect wiring when attached to a given position.

Another object of the present invention is to provide a press-contact connector assembly which can effectively produce a harness which needs a branched wiring and which can be disposed in a narrow space.

Another object of the present invention is to provide a press-contact connector assembly which can effectively produce a harness which needs a branched wiring and which can effectively utilize an arranging space without projecting the branched wiring from a main line.

Another object of the present invention is to provide a press-contact connector assembly for a socket Joint of a lighting fixture, which can be easily constructed without using a special tool.

In order to achieve the above objects, a press-contact connector assembly in accordance with the invention of claim 1 comprises: a terminal having a coupling portion on an end thereof and a press-contact portion on the other end thereof, said press-contact portion being provided with a press-contact slot an inlet port of which is arranged in a direction perpendicular to an axial direction; and a connector case having a cylindrical portion for accommodating and holding said terminal therein and a press-opening formed on an upper wall of said cylindrical portion in communication with said press-contact portion.

In the above connector assembly, when the terminal is inserted into the cylindrical portion of the connector case, the terminal is supported in the cylindrical portion and the press-contact portion of the terminal communicates with the outside through the press-opening in the cylindrical portion. When press-contacting the cable, it is pushed through the press-contact opening into the press-contact slot in the press-contact portion held in the cylindrical portion. Since the cable is pushed into the press-contact slot, the pushed cable is disposed perpendicular to the slot. On the other hand, the inlet port of the press-contact slot is arranged in a direction perpendicular to the axial direction. In the case that all inlet ports are arranged in the same direction and a plurality of terminals are arranged in the inlet ports, the cable which is positioned vertically with respect to the slot having the inlet port perpendicular to the terminal axis will define a plane parallel to a plane defined by the terminals. That is, the branched line is drawn out along the main line without projecting the branched line from the main line.

In order to achieve the above objects, an embodiment of the connector assembly of the invention further comprises a restriction cover, adapted to be coupled to an end of said connector case in which said terminal is disposed, for restricting an extracting of an electrical cable to be press-contacted with said terminal.

In the above connector assembly, although the cable press-contacted in the terminal is disposed in parallel with the arranging plane of the terminal and in perpendicular to the inlet port, the restriction cover can restrict the extraction of the cable in a desired direction when the cover is put on the end portion in which the terminal is disposed. Accordingly, if the cover restricts the cable so that the cable is directed to a position needing the branched line, the branched line does not become unstable. Also, if the cover restricts the cable so that the cable is oriented in parallel with the coupling direction, the cable is parallel with the branched line and thus a projected portion of the cable can be reduced.

In order to achieve the above objects, the present invention includes the restriction cover which has a clamp for attaching the assembly to a given position.

In the above connector assembly, said terminal is disposed in the end of said connector case and said restriction cover is put over the terminal. When the cover is attached to the given position by the clamp, the cover, cable, and press-contact connector case are put on the attaching area in order. Thus, the connector case is disposed on the most front side.

In order to achieve the above objects, in the present invention, said inlet port of said terminal is arranged in said connector case so as to receive said electrical cable when it is horizontally supported and lowered as it is; and wherein said connector case has a plurality of cable-holding portions which receive a plurality of terminals having different lengths in parallel with each other and in stepped positions.

Also, in the connector assembly of the present invention, said press-contact portion of said terminal is provided with a plurality of press-contact grooves.

In the connector assembly of the present invention the terminals are juxtaposed in the connector case and the press-contact portions are disposed in the same plane although they have different lengths. The press-contact portions are disposed on the same plane in the cable-holding portions. When the respective cables are inserted into the press-contact slots of the respective press-contact portions while leading them to the slots in the same direction, the respective cables are arranged in the same plane although they are oriented in the direction perpendicular to the terminal axis.

That is, the plane defined by the cables is parallel to the plane defined by the terminals and the cables are oriented in the direction perpendicular to the terminal axis. Accordingly, the cable can be branched without projecting in the thickness direction.

In the present invention, it is possible to effect a branching connection to the connector assembly simultaneously with a branching connection to another cable, since the cables are electrically conducted to each other through the press-contact portions when the respective cables are press-contacted in the press-contact slots in the press-contact portions.

In order to achieve the above objects, in the present invention, said press-contact portion receives said electrical cable in a fitting direction perpendicular to a press-contacting direction to form a branched circuit.

Also, in the present invention, a branched line is arranged in parallel with a support base plate which supports a main cable.

In the present invention, since the direction of press-contacting the cable to the terminal is substantially perpendicular to the direction of coupling the terminal to the mating terminal, the mating terminal lies in the plane which is superimposed on the plain defined by the cables. Consequently, the branched line is drawn along the main line without projecting from the main line.

Also, in the present invention, the branched line is branched in the direction parallel with the arranging plane when the main line is disposed in the arranging plane.

In order to achieve the above objects, the connector assembly for the socket joint of the lighting fixture in accordance with another embodiment, comprises: a press-contact electrode having a press-contact blade on an end thereof and a power supply terminal on the other end thereof; and a casing including a hood for receiving a lighting fixture electrode, a cylindrical portion for holding said press-contact electrode so that said power supply terminal contacts with said lighting fixture electrode in said hood, and a guide portion for defining a guide path to introduce said cable into said press-contact blade.

In this embodiment, when the press-contact electrode is inserted into the cylindrical portion of the casing the power supply terminal of the press-contact electrode is inserted into the hood of the casing and contacts with the electrode of the lighting fixture when it is inserted into the hood. On the other hand, when the cable is inserted into the guide path in the guide portion while the press-contact electrode is accommodated in the cylindrical portion, the cable is guided to the press-contact blade along the guide path and press-contacted with the blade. That is, all connections can be done without using any special tool.

DETAILED DESCRIPTION OF THE PREFERRED EMBODIMENTS

Referring now to FIGS. 1 to 11, a first embodiment of the present invention will be described below.

Figure 1:
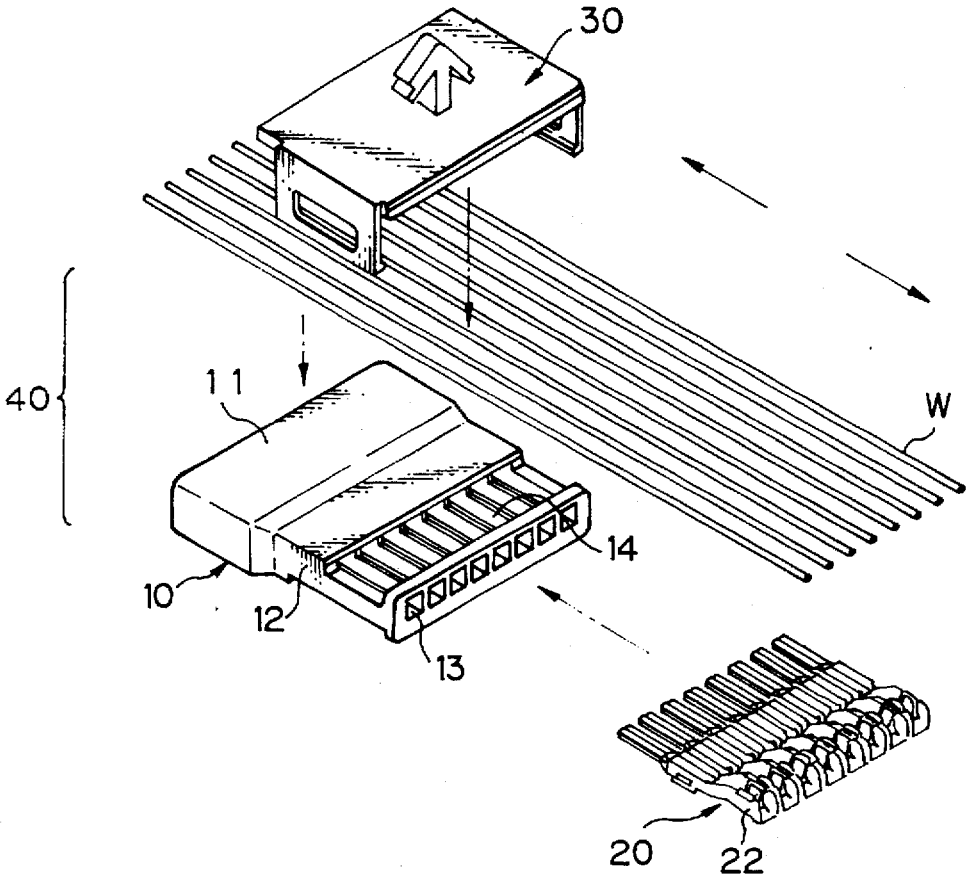
FIG. 1 is an exploded perspective view of a first embodiment of a press-contact connector assembly for a wire harness in accordance with the present invention.
Figure 2:
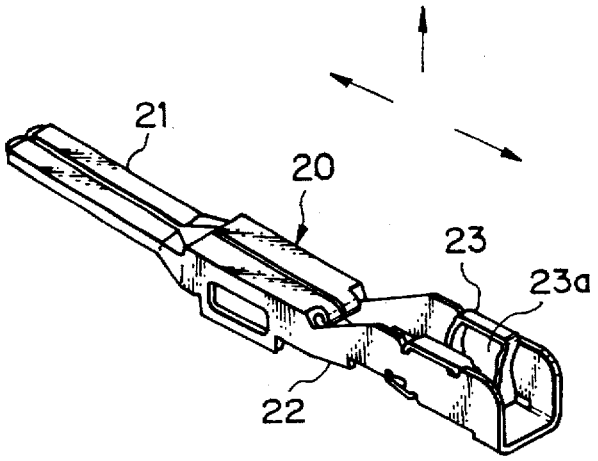
FIG. 2 is a perspective view of a terminal.
Figure 3:
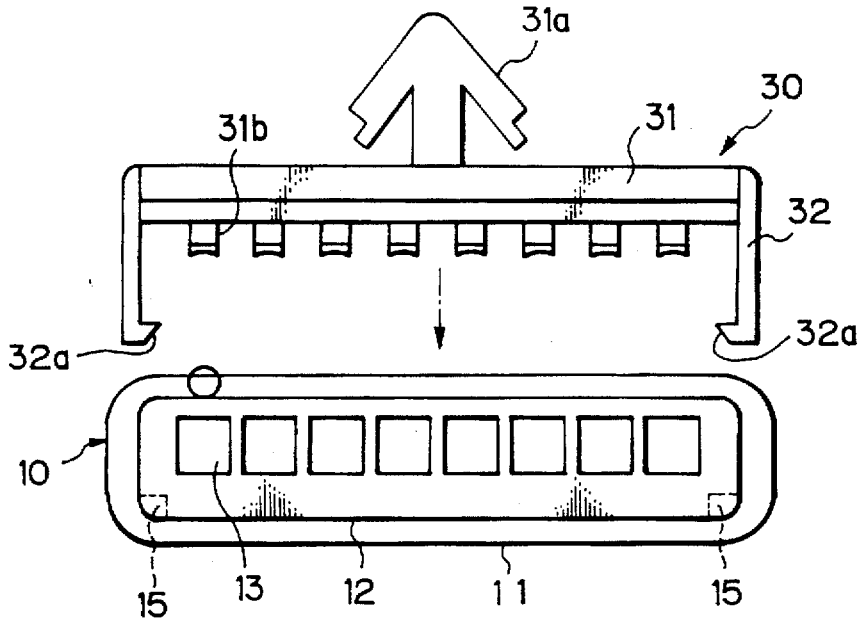
FIG. 3 is a rear side elevation view of a connector case and a restriction cover.

In FIGS. 1 and 2, a connector case 10 is provided with a hood 11 at a front end (on the left hand in the drawing) and with a terminal-holding part 12 at the rear end (on the right hand). The connector case 10 has provided in the terminal-holding portion 12 eight cylindrical portions 18 which receive and hold a terminal 20. An opening 14 is formed in an upper rear wall of the terminal-holding portion 12. On the other hand, the terminal 20 is provided with a male coupling portion at a front end (lefthand in the drawing) and with a press-contact portion 22 at a rear end (righthand in the drawing). The press-contact portion 22 is formed into a U-shaped cross section so as to have an opening in an upper end. A press-contact metal member 28 is received in the portion The member 23 defines a press-contact slot 23*a* which extends downwardly. When an electrical cable W is pushed down into the slot 23*a*, the opposite edges on the metal member 23 cut through the sheath of the cable so that conductors of the cable are exposed and electrically connected to the metal member 23. Since the slot 28*a* extends downwardly in the terminal 20, the direction of insertion of the terminal 20 is perpendicular to the axial direction thereof.

Figure 8:
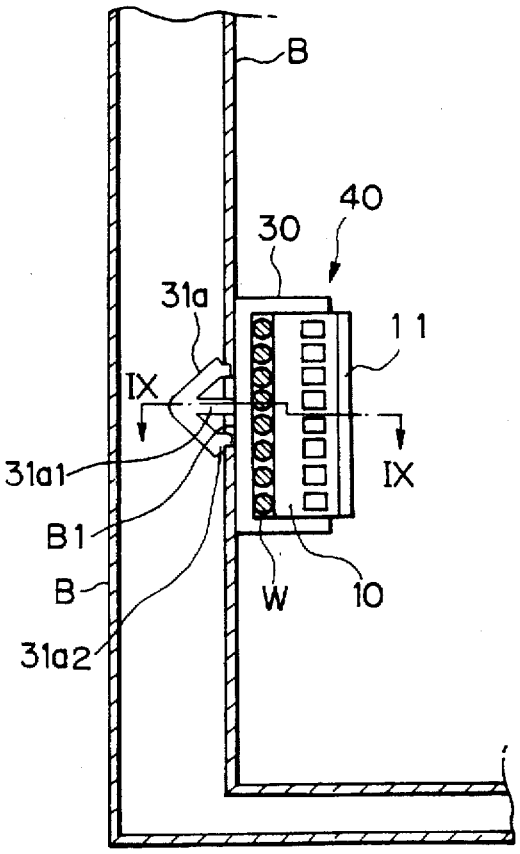
FIG. 8 is a cross sectional view of the wire harness which is secured to an inner wall of a trunk.

As shown in FIG. 8, a cover 80 includes a ceiling plate 31 which is larger than the opening 14 in the connector case 10 and side plates 32 which extend downwardly from the opposite ends of the ceiling plate 81. The ceiling plate 31 is provided with a clamp 31*a* on the upper side thereof and with push-down projections 31*b* which extend down toward the cylindrical portion 13 on the lower side thereof. The side plate 32 is provided on the lower end with a lock pawl 32*a* which extends inwardly. The connector case 10 is provided at its opposite lower ends with recesses 15 which engage with the lock pawls 32*a*.

Figure 4:
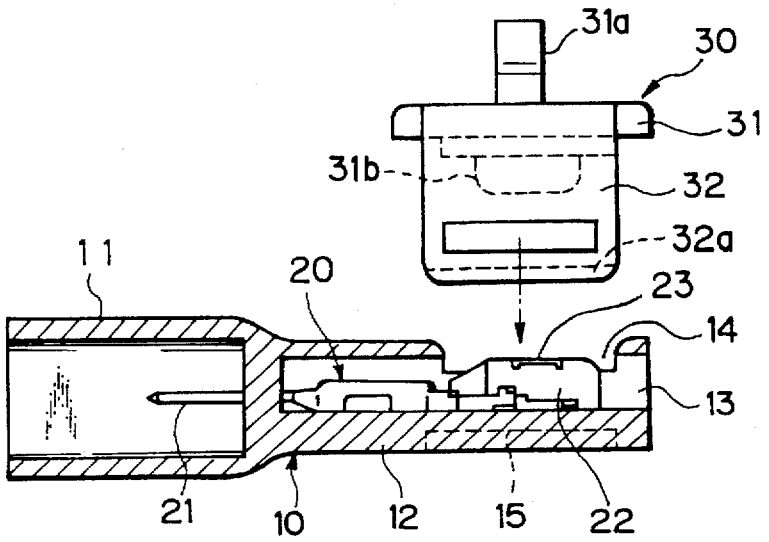
FIG. 4 is a cross sectional view of the connector case, illustrating a state after the terminal is received in the case.
Figure 5:
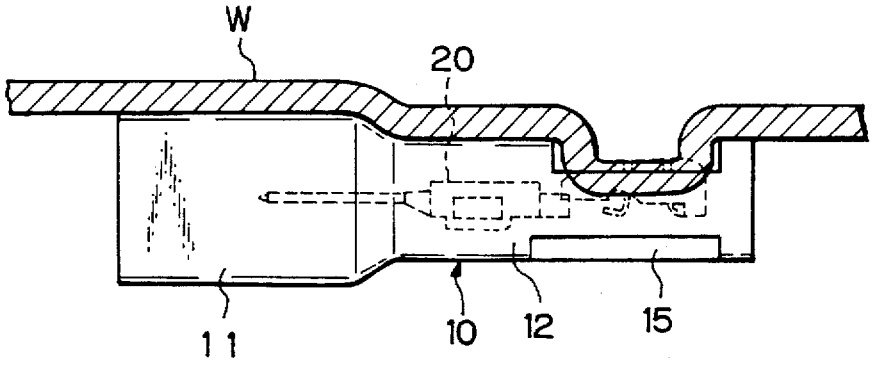
FIG. 5 is a cross sectional view of the connector case, illustrating a state after an electrical cable is press-contacted with a squeezable slot in the case.
Figure 6:
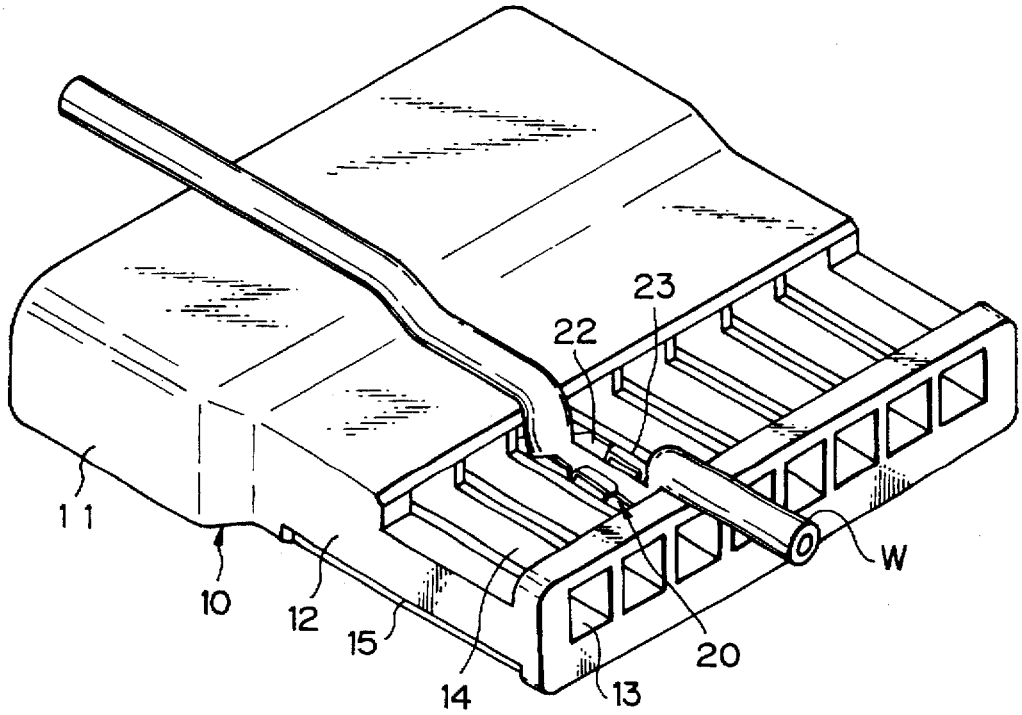
FIG. 6 is a perspective view of the connector case, illustrating the state after the electrical cable is press-contacted with the squeezable slot in the case.

Next, an operation of the first embodiment will be explained below. As shown in FIG. 4, the terminal 20 is inserted into the cylindrical portion 13. A method of holding the terminal 20 in the cylindrical portion 13 may be a common engagement method. When the terminal 20 is inserted into a given position in the cylindrical portion 13, the press-contact portion 22 is disposed under the opening 14 in the connector case 10 and the press-contact metal member 23 is opposed to the opening 14. When the electrical cable W to be press-contacted is slid onto the upper side of the connector case 10 and the cable W over the opening 14 is pushed down into the cylindrical portion 13, the cable W is inserted into the press-contact slot 23*a* in the press-contact metal member 23*a*. FIGS. 5 and 6 show the final position of the connector assembly. Since the edges of the metal member 23 cut through the sheath of the cable W when the cable W is inserted into the press-contact slot 23*a*, the member 23 contacts with the conductors of the cable to form an electrical connection. Thus a desired member of the conductors is press-contacted with the members 23.

Then, when the cover 30 is pushed toward the connector case 10, the lock pawls 32*a* on the side plates 32 abut on the side faces of the connector case 10 and the side plates are deflected outwardly. When the side plates 32 are further pushed down, the push-down projections 31*b* abut on the upper faces of the cable W inserted in the cylindrical portion 13 and further compress the cable W. When the push-down projections 31*b* press the cable W into a given position in the press-contact slot 23*a*, the lock pawls 32*a* engage with the recesses 15 in the side walls of the connector case 10.

Figure 7:
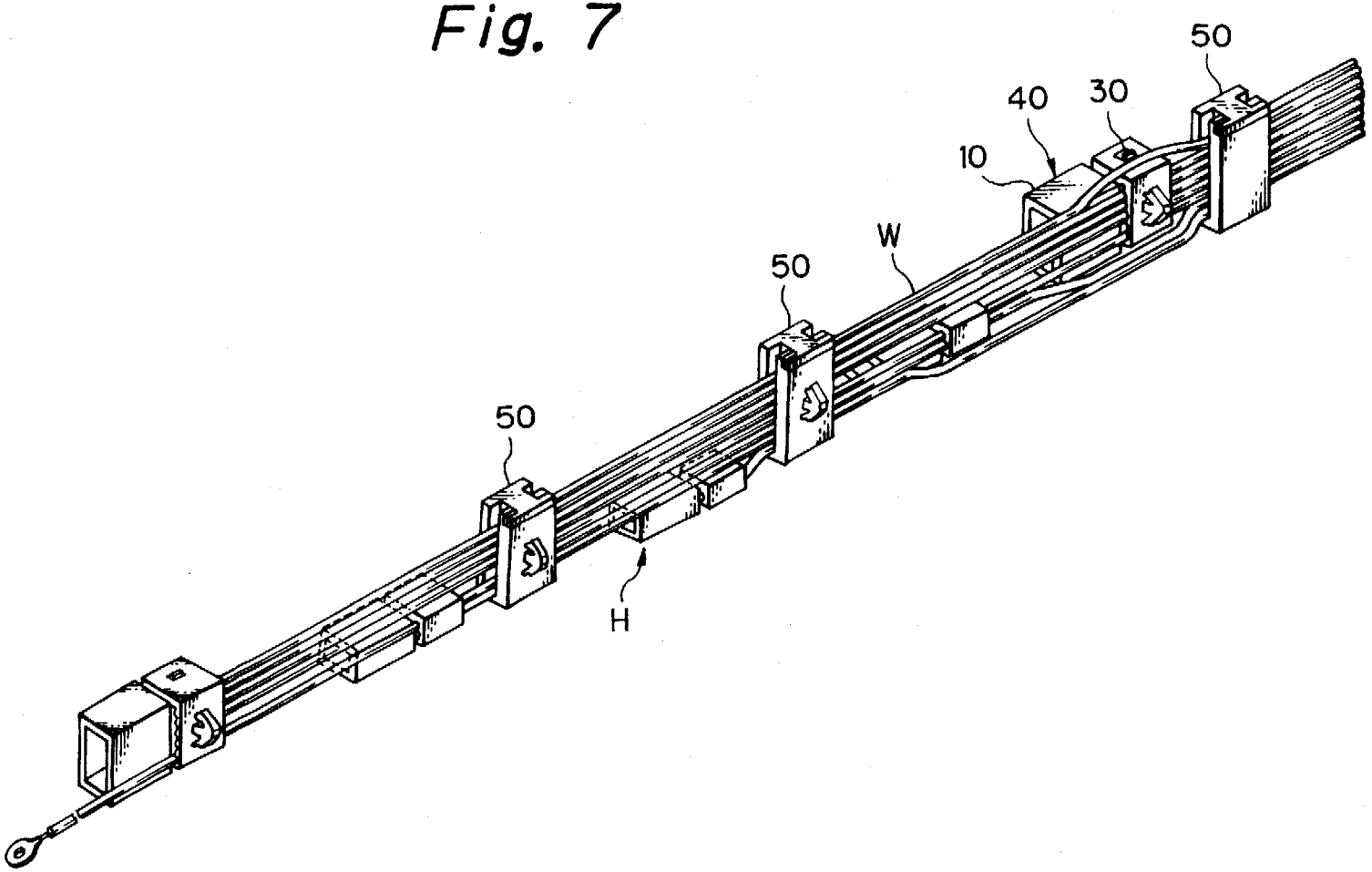
FIG. 7 is a perspective view of an assembled wire harness.

FIG. 7 shows a wire harness H in which the press-contact connector assembly 40 is connected to an intermediate portion of the electrical cable W. The hood 11 of the connector assembly 40 is arranged in parallel with a wiring direction of the cable. In the case that an intermediate electrical cable having connectors at opposite ends is arranged between a rear combination lamp for an automobile and the press-contact connector assembly 40, the intermediate cable is disposed in parallel with the harness H. That is, since the mating intermediate cable connected to the connector assembly 40 does not project from the harness H, there is no problem even if the harness H such as a harness for an automobile must be arranged in a narrow space.

If the wire harness H is arranged on an inner wall of a trunk in the rear side of the automobile, the clamp 31*a* is directed to and secured to a car body B as shown in FIG. 8. The cable W is arranged in the direction perpendicular to the paper surface of the drawing and the hood 11 of the press-contact connector assembly 40 also spreads in the direction perpendicular to the paper surface of the drawing.

In the case of attaching the harness H to the car body B, the clamp 31*a* of the connector assembly 40 is pushed into a hole B1 in the car body B. Since a diameter of the hole B is smaller than a distance between wings 31*a*2 which spread on both sides of a trunk 31*a*1, the wings 31*a*2 abut on the periphery around the hole B1. However, when the wings 31*a*2 are further pushed down, the wings 31*a*2 are deflected inwardly to the trunk 31*a*1 so that they can pass through the hole B1. When the wings 31*a*2 pass through the hole B1, they spread again and are further spread by an external pulling force, thereby preventing the wings from slipping out of the hole.

Figure 9:
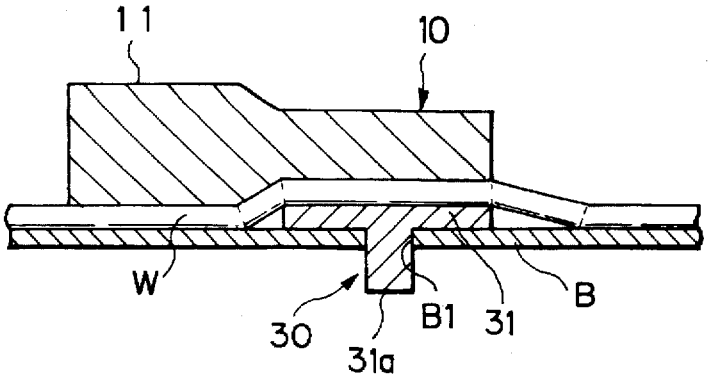
FIG. 9 is a cross sectional view taken along lines IX—IX in FIG. 8, illustrating an order of steps of fixing the connector assembly on a car body.

Thus, as shown in FIG. 9, the ceiling plate 31, cable W and connector case 10 are stacked in order on the car body B. Although a mating connector is inserted into the hood 11 of the connector case 10, there Is no element in front of the hood 11 since the cable is arranged at the rear side of the hood 11. Accordingly, the connector can be easily interconnected In the hood 11.

Although the cover 30 is separated from the connector case 10 in the present embodiment, the cover 30 may be connected through a hinge to the connector case 10. Also, the opening 14 may be closed not by the cover 30 but by insulation tape.

Figure 10:
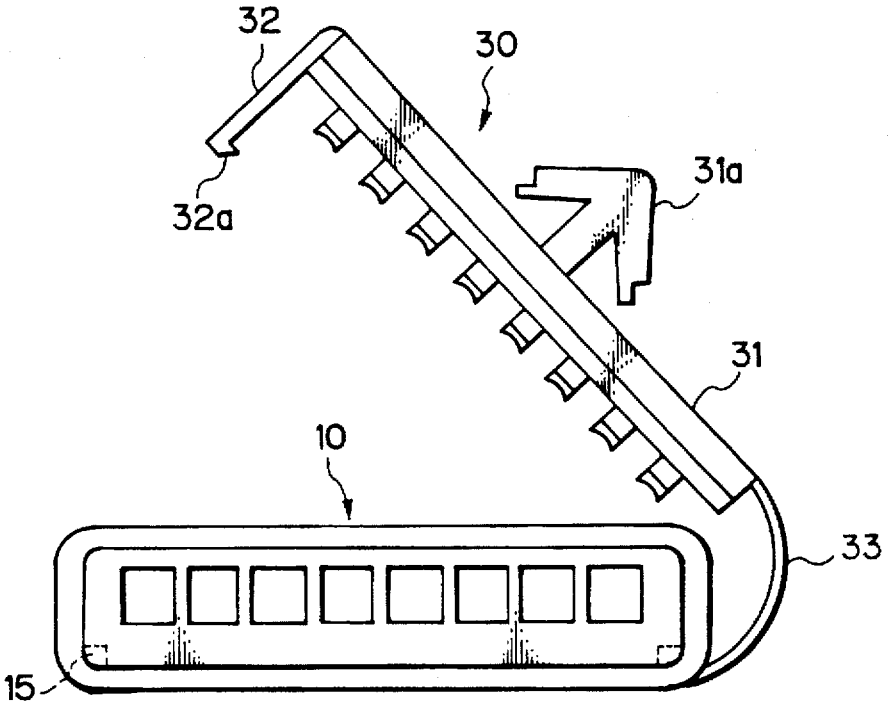
FIG. 10 is a rear side elevation view of an alternation of a cover.

For example, as shown in FIG. 10, the cover 30 1s not separated from the connector case 10 in the press-contact connector assembly 40 but integrally connected to the case 10 through a strip 33 instead of the side plate 32.

Upon attaching the cable to the assembly, after the cable W is put on the opening 14 in the same manner as that described above, the remainder side plate 32 engages with the side wall of the connector case 10 while bending the strip 33.

Figure 11:
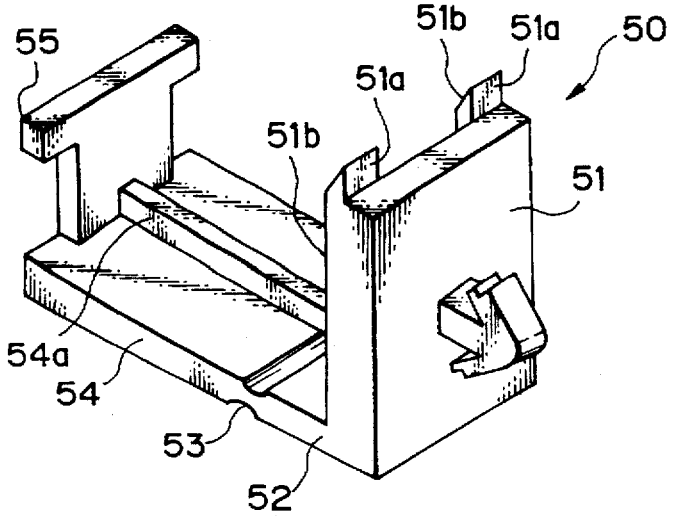
FIG. 11 is a perspective view of a clip.

In FIG. 7, clips 50 are arranged on an intermediate portion of the wire harness H, to bring together the electrical cables W constituting the harness H. The clip 50, as shown in FIG. 11, includes a support plate 51, a connection plate 52 which extends rectangularly from a lower end of the support plate 51, a hinge portion 53 and a press plate 54 which is connected through the hinge portion 53 to the connection plate 52. The press plate 54 is provided at an end with an lock portion 55 which stands on the end thereof. The support plate 51 is provided at an upper end with lock pawls 51*a*. The lock portion 55 engages with the lock pawls 51*a* when the clip 50 is bent. The support plate 51 is provided on the opposite side ends with rail like portions 51*b* directed to the press plate 54 while the press plate 54 is provided on the center with a rail like portion 54*a* directed to the support plate 51. The cables W are placed on the support plate 51 and the press plate 54 is bent toward the support plate 51 around the hinge portion 53. When the press plate 54 is bent by 90 degrees, the lock portion 55 engages with the lock pawls 51*a*, so that the clip 50 clamps and holds the cables W.

At this time, the cables W are clamped between three rail like portions 51*b*, 51*b* and 54*a*, thereby preventing the cables W from slipping or shifting in the clip 50. If the clips 50 are attached to the cables W near the branched positions, the clips will serve to indicate the branched positions as markers, thereby simplifying the work involved.

The wire harness H thus constructed does not generate noise under car vibration, since the harness H is supported on the car body by means of the clamp.

A second embodiment of the present invention will be explained by referring now to FIGS. 12 and 13.

Figure 12:
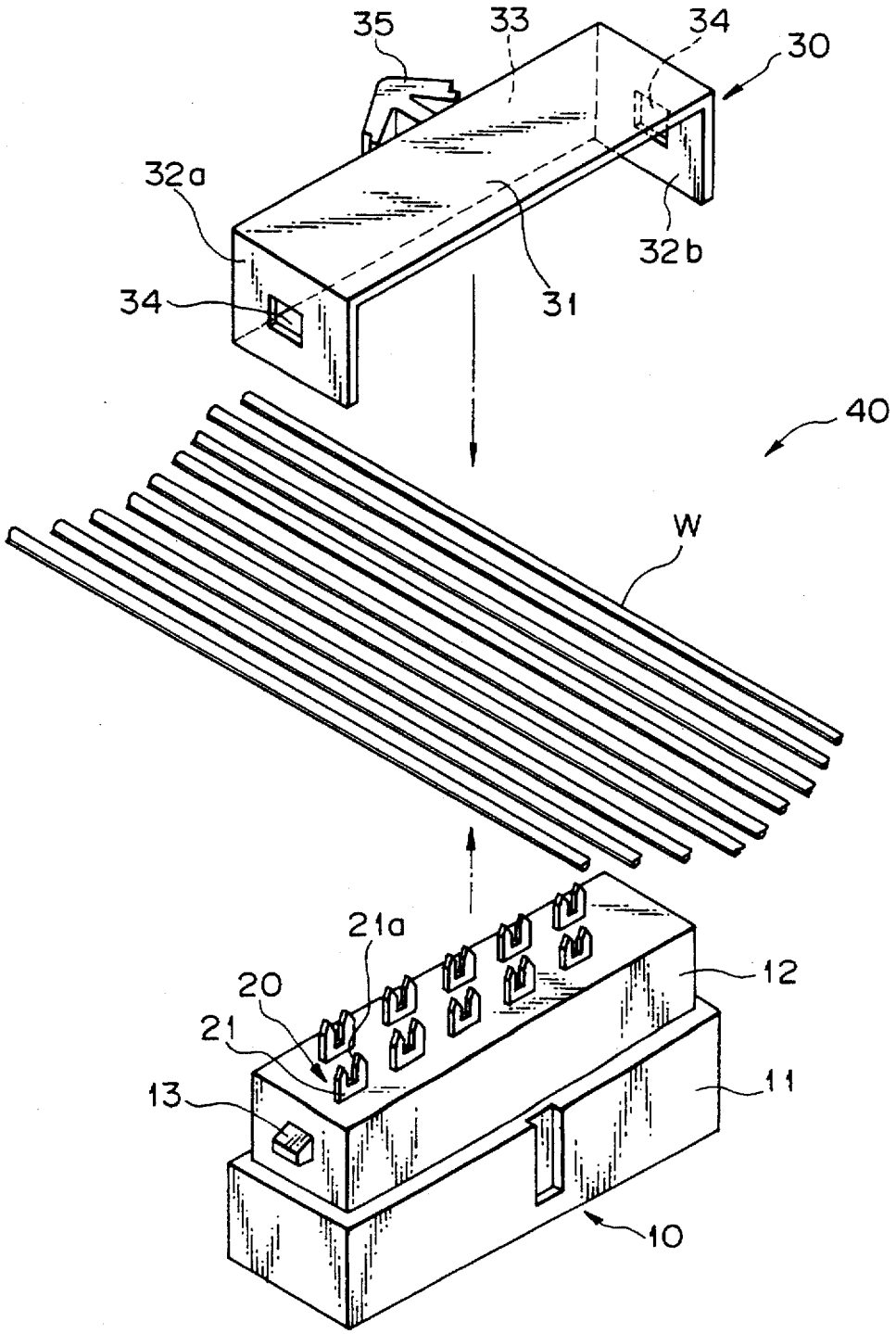
FIG. 12 is an exploded perspective view of a second embodiment of the press-contact connector assembly of the present invention.

FIG. 12 is an exploded perspective view of the second embodiment of the press-contact connector assembly of the present invention. FIG. 13 shows a perspective view of a constructed connector assembly.

In the drawings, the connector case 10 comprises a hood 11 and a terminal-holding part 12. A terminal 20 is held in the terminal-holding part 12. The terminal 20 is provided at one end with a press-contact portion (press-contact metal member) 21 having a press-contact slot 21*a* and at the other end with a coupling terminal (coupling metal member). The terminal 20 is held in the part 12 at an intermediate portion thereof. That is, the terminal 20 is held in the connector case 10 with the press-contact portion 21 projecting from an end face of the part 12 and the coupling terminal projecting into the hood 11. The connector case holds a plurality of terminals 20 with the press-contact portion 21 projecting from the part in a zigzag manner.

A cover 30 which is put on an end of the terminal-holding part 12 of the connector case 10 comprises a base wall 31 opposed to the end, engaging walls 32*a* and 32*b* which extend downwardly from opposite longitudinal ends of the base wall 31 and a restriction wall 33 which extends downwardly from one of opposite longitudinal sides and interconnects the engaging walls 32*a* and 32*b*. The terminal-holding part 12 of the connector case 10 is provided with a pair of lock pawls 13 on its opposite side faces. Lock 32 are formed in the engaging walls 32*a* and 32*b* to be associated with the lock pawls 13.

Also, a clamp 35 stands on the restriction wall 33.

An operation of the second embodiment will be described below.

Upon assembling, after the terminals 20 are arranged in the connector case 10 beforehand, the connector case 10 is positioned so that the hood 11 is directed downwardly as shown in FIG. 12. When sheathed electrical cables W are pushed into the press-contact slots 21*a* in the press-contact portions 21 of the terminals 20, edges of the press-contact slots 21*a* cut through the sheaths so that the edges contact with conductors and are electrically connected to the conductor.

Then, when the cover 30 is pushed down to the connector case, the engaging walls 32*a* and 32*b* are pushed down without contacting the cables W, but the restriction wall 33 contacts with the cables W at its lower end, so that it bends the cables W downwardly. While pushing the cover 30 down gradually, the cables W are bent by 90 degrees so that the cables W closely contact with the interior of the connector case 10 and the engaging walls 32*a* and 32*b* abut on the lock pawls 13 of the connector case 10.

Since the engaging pawl 13 has a slant face at an upper side, the engaging walls 32*a* and 32*b* ride on the slant face and are deflected outwardly when the cover 30 is pushed down. The lock pawls 13 are inserted into the holes 34 in the engaging walls 32*a* and 32*b*, thereby coupling the cover 30 to the connector case 10 when the rear side of the base wall 31 approaches the press-contact portions 21 of the terminals 20.

Figure 13:
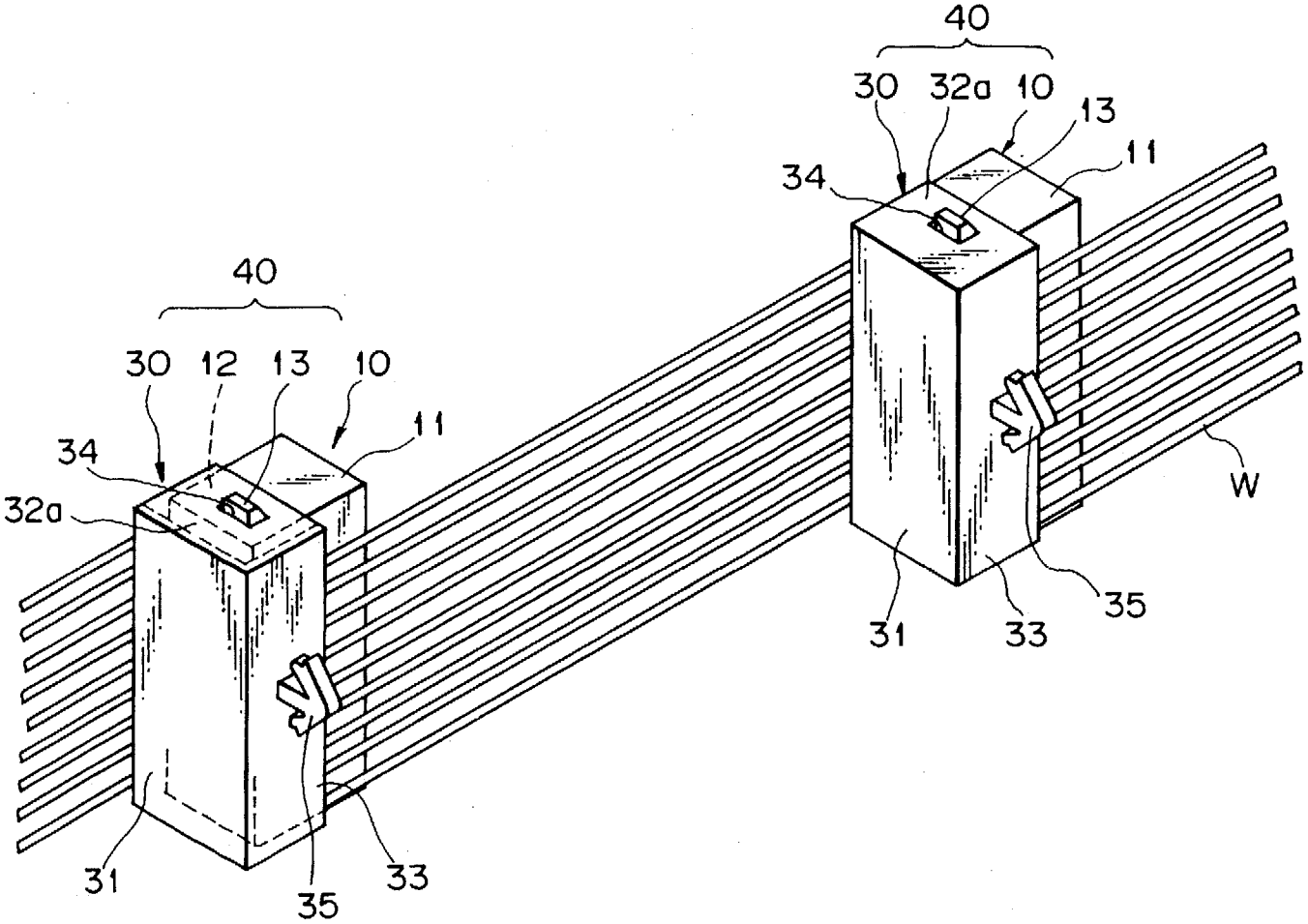
FIG. 13 is a perspective view of a constructed press-contact connector assembly of the second embodiment.

FIG. 13 shows a wire harness in which two press-contact connector assemblies 40 are arranged on an intermediate portion of a plurality of sheathed electrical cables W. As shown in FIG. 13, the sheathed electrical cables W are clamped between the connector case 10 at the terminal-holding part 12 and the cover 30 and limited to a given extracting direction. That is, the cables W are extracted from the hood 11 along the restriction wall 33. This causes the extracting direction to be oriented in parallel to the coupling direction.

The wire harness H can be secured to a car body of an automobile by means of the clamp 35. When secured to the car body, the coupling direction of the connector case 10 is arranged in parallel to the attaching face on the car body and a branched line does not project from a main line even if the branched line is provided on the main line. Accordingly, it is possible to easily arrange a branched line in even a narrow space.

Although only one of the extracting directions of the electrical cable is restricted in the embodiment described above, both of the extracting directions may be restricted. Also, the restriction direction is not always parallel to the coupling direction and the cable may be extracted in a direction of 45 degrees when it is desired.

A third embodiment of the present invention will be described below by referring to FIGS. 14 to 17.

Figure 14:
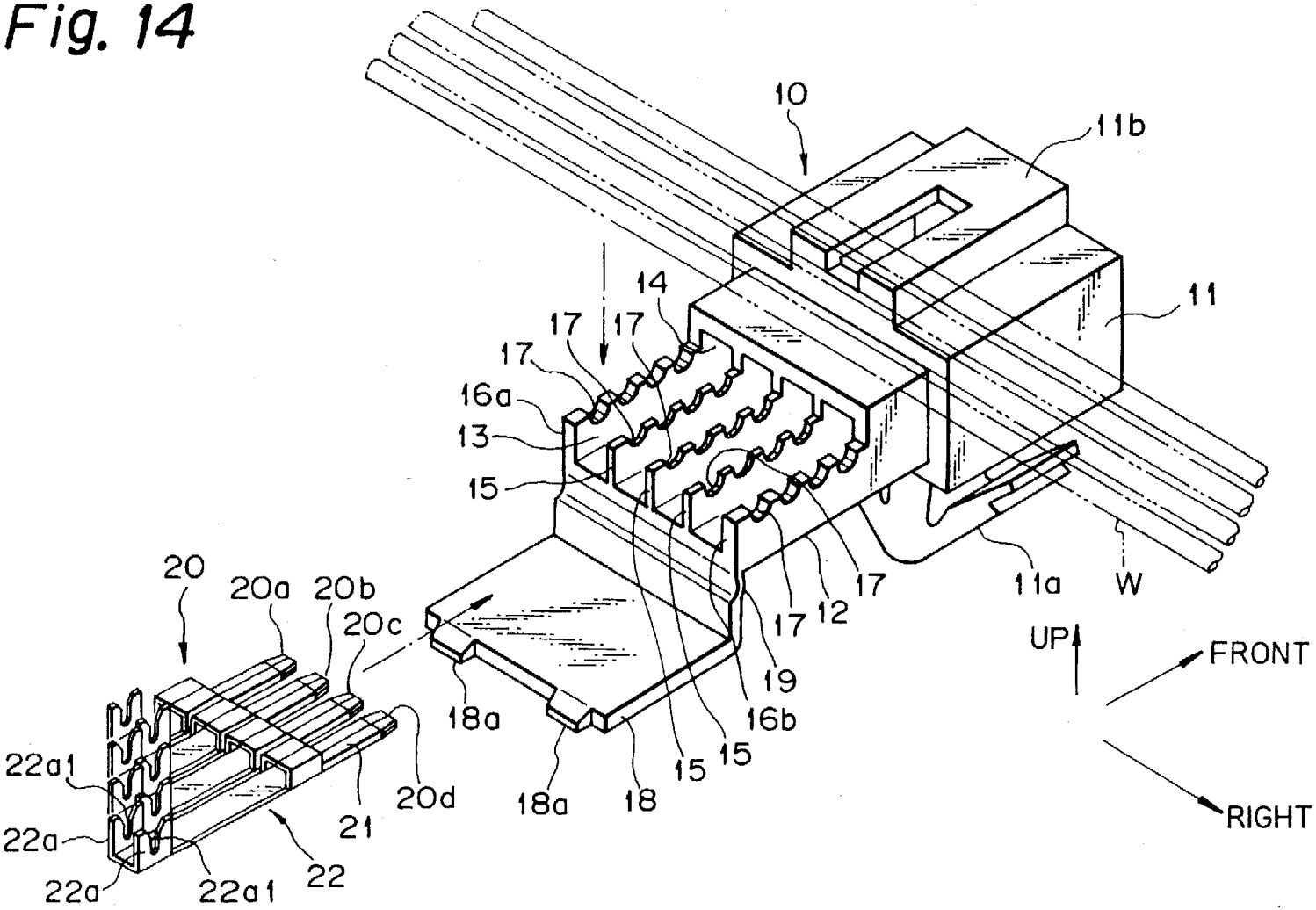
FIG. 14 is an exploded perspective view of a third embodiment of the press-contact connector assembly of the present invention.
Figure 17:
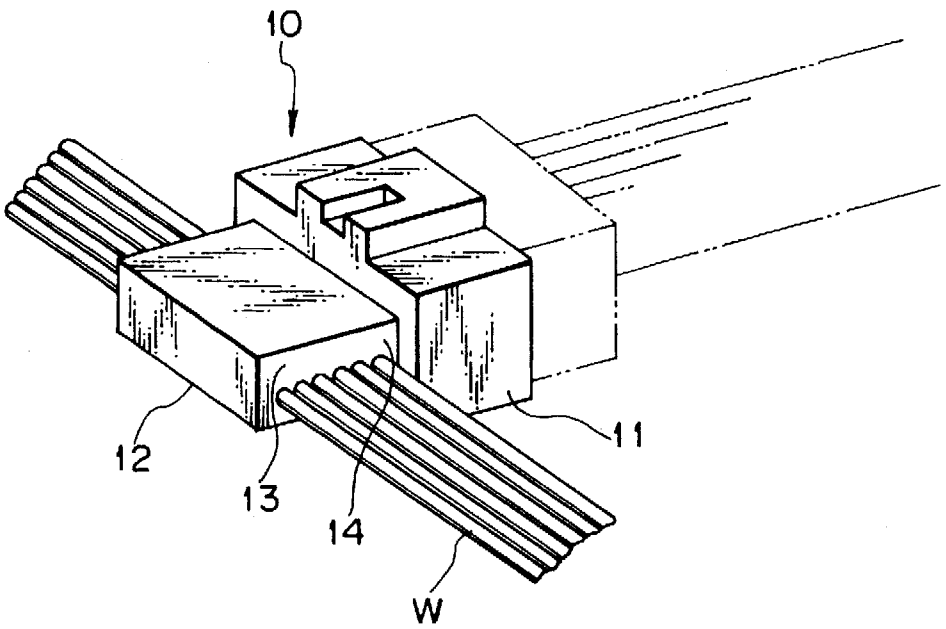
FIG. 17 is a perspective view of a constructed press-contact connector assembly shown in FIG. 14.

FIG. 14 shows an exploded perspective view of the third embodiment of the press-contact connector assembly of the present invention. FIG. 17 shows a perspective view of the constructed assembly.

In the drawings, a connector case 10 comprises a hood 11 and a body part 12. The hood 11 is provided with a clamp 11*a* at a lower face and with a raised portion 11*b* at an upper face so as to prevent a mating connector from slipping out of the connector case when the mating connector is coupled.

On the other hand, the body part 12 is provided with cable-holding portions 18 which have openings provided at an upper side and are formed into grooves, and with terminal-holding cylindrical portions 14 which are formed at a front side of the portions 13. The cable-holding portions 18 and terminal-holding portions 14 are defined by partitions 15 at every terminal 20.

Four semicircular grooves 17 opened upwardly are formed in each of the partitions 15 in the cable-holding portions 13 and opposite side walls 16*a* and 16*b* of the connector case 10. Each of the grooves 17 are aligned laterally in the connector case 10.

A cover member 18 which is Put over a rear opening and an upper opening in the cable-holding portions 13 is connected through a hinge portion 19 to an end of the cable-holding portions 13. The cover member 18 is provided with a pair of lock pawls 18*a* at an end thereof.

The terminal 20 is provided with a coupling portion 21 at an end thereof and with a press-contact portion 22 at the other end thereof. The press-contact portion 22 is provided with opposite T-shaped metal wings 22*a* having press-contact slots 22*a* 1 and standing on an end of the portion 22. Each of four terminals 20 has each of the press-contact portions 22 with different lengths. The differences between the lengths depend on the distances between the cables W to be press-contacted. These distances accord with distances between the grooves 17 in the walls 15, 16*a* and 16*b*. For convenience of explanation, the grooves 17 are designated 1st to 4th grooves in order from the front side and also the terminals 20 are designated terminals 20*a* to 20*d* in order from the shortest one.

An operation of the third embodiment will be explained below.

The terminals 20*a* to 20*d* are arranged in order from the shortest one and are inserted into the grooved cable-holding portions 13 in the connector case 10. Since the portions 13 are divided by the partitions 15 of every cable W, terminals 20 are inserted into grooved portions 13 one by one.

When the terminals 20*a* to 20*d* are inserted from the cable-holding portions 13 into the terminal-holding portions 14, the press-contact slots 22*a*1 of the terminals 20*a* to 20*d* are linearly aligned to the 1st to 4th grooves 17 since the press-contact portions 22 are different in length.

After four cables W are inserted into the 1st to 4th grooves 17, the cables W are pushed into the press-contact slots 22*a*1 of the terminals 20*a* to 20*d* one by one. When the cables W are pushed into the slots 22*a*1, edges of the slots cut through the sheaths of the cables and are electrically connected to the conductors, thereby branching the cables W to the terminals 20*a* to 20*d*.

After press-contacting, the cover member 18 is bent around the hinge portion 19 so that the cover member 18 is put on the portions 13 and the lock pawls 18*a* engage with the ends of the terminal-holding portions 14.

FIG. 17 shows the connector case 10 to which a mating press-contact connector assembly is attached. As shown in the drawing, since a plane defined by four cables W to be connected to the press-contact connector assembly is parallel to a plane defined by four cables to be branched, the branched line does not project from the main line and thus the connector assembly can be used in a narrow space. When the clamp 11*a* on the hood 11 is pushed into the hole in the car body, the connector assembly is secured to the car body. Then, each cable is arranged in parallel in an attaching face on the car body and does not project in the thickness direction, thereby simplifying necessary work.

Figure 15:
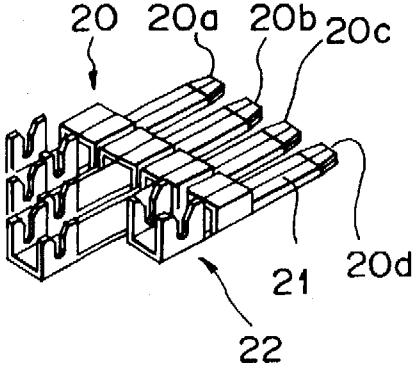
FIG. 15 is a perspective view of another terminal.

Although the cables W are disposed perpendicular to the terminals in the above embodiment, the cables may be inclined within a small range. Although four cables W are press-contacted to the terminals 20*a* to 20*d* one by one, all terminals 20 may not be press-contacted and the cables W which are not branched can be utilized as a support. Also, although the terminals 20*a* to 20*d* are arranged in order from the shortest one, the order may be free as shown in FIG. 15.

Figure 16:
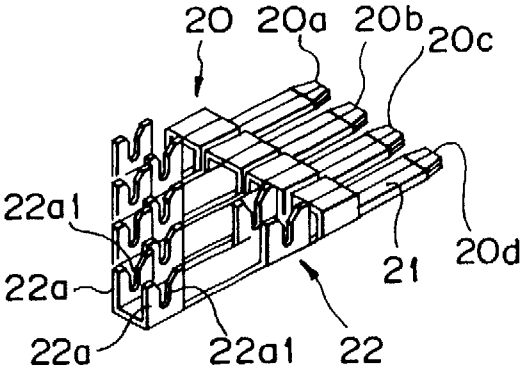
FIG. 16 is a perspective view of still another terminal.

The press-contact connector assembly shown in FIG. 16 is provided with two press-contact slots 22*a*1 in the press-contact portion 22 of the terminal 20*d*. When the cables W are pushed into the 1st and 4th grooves 17 in the connector case 10 by using the terminal 20d, the cables are electrically connected to the terminal 20*d*. That is, branched wiring To the coupling portion 21 and between the cables W can be carried out at the same time.

Figure 18:
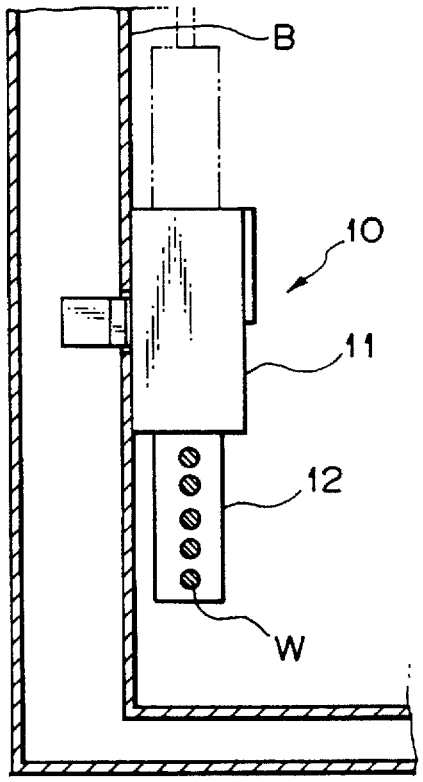
FIG. 18 is a cross Sectional view of a wire harness which is secured to a vehicle compartment.
Figure 19:
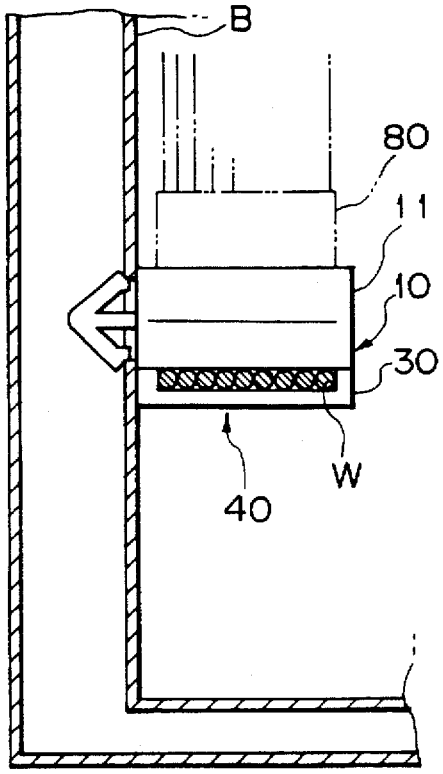
FIG. 19 is a cross sectional view of a wire harness, illustrating a wiring method which eliminates an amount of projection of the harness into the vehicle compartment.

FIGS. 18 and 19 show the wire harness H secured to the car body B. In FIG. 18, the cables W are arranged in a direction perpendicular to the paper face of the drawing and the branched cables are arranged in a vertical direction on the paper face. Namely, the cables are arranged on the wall of a car interior and do not project in the car interior thereby saving a space.

In the case that the wire harness H is arranged on a wall of the car interior, it is possible to reduce a projected amount of the branched line in the car interior and to reduce a space for arrangement by arranging the branched line along the wall. FIG. 19 shows a method for reducing a projected amount of the cables in the car interior by using a press-contact assembly 40 in which a branched line projects perpendicularly from a main line. In the drawing, the hood 11 of the connector case 10 is opened upwardly and the cover member 30 supports the cables W arranged in the height direction of the case 10. A mating connector 80 is displaced downwardly and inserted into the hood 11. In this case, the cables W are arranged along the wall of the car interior and the branched cables are arranged along the wall.

A fourth embodiment of the present invention will be explained below by referring to FIGS. 20 and 21.

Figure 20:
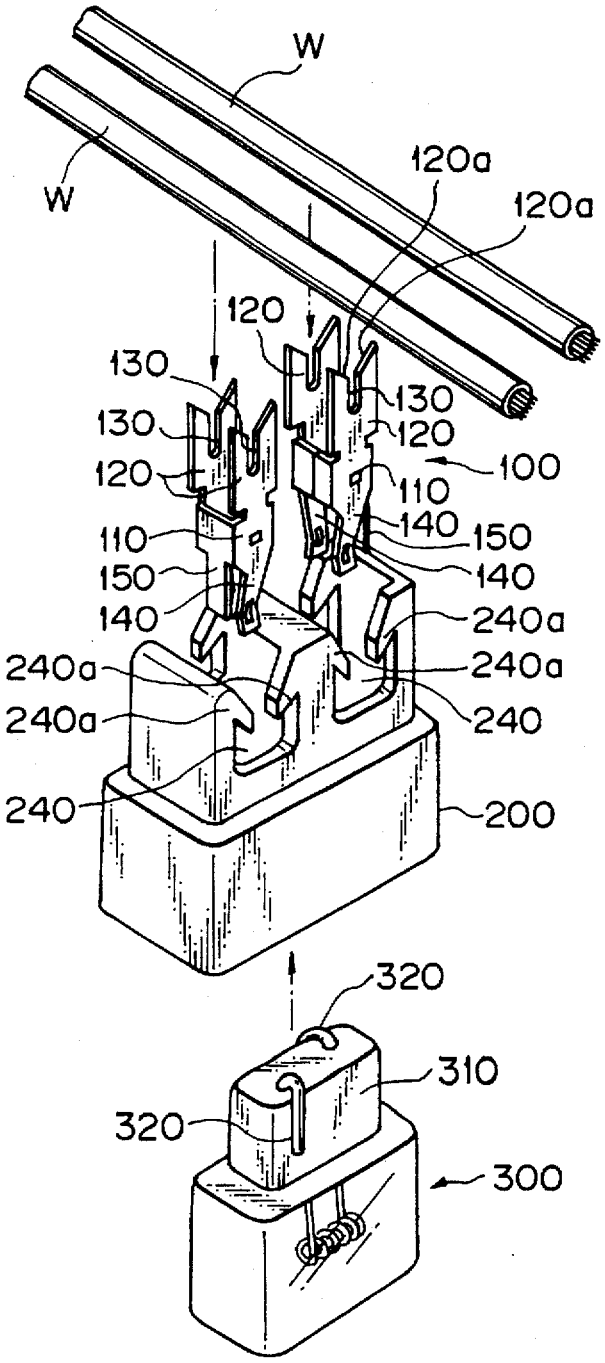
FIG. 20 is an exploded perspective view of a fourth embodiment of a socket Joint for a lighting fixture in accordance with the present invention.

FIG. 20 show an exploded perspective view of a press-contact connector assembly for a socket Joint for a lighting fixture in accordance with the present invention. In the drawing, a press-contact electrode 100 includes a metal box like body 110. The body 110 is provided with two opposed press-contact portions 120 which extend therefrom upwardly. A press-contact slot 180 is formed in an end of the press-contact portion 120 and extended in the axial direction toward the body 110. Upper ends 120*a* of the press-contact portion 120 are inclined toward the slot 130.

On the other hand, the body 110 is provided at a lower end with a pair of electrical power supply terminal portions 140 which are bent toward each other and with a pair of electrode-clamping pieces 150 which extend downwardly and straightly.

Figure 21:
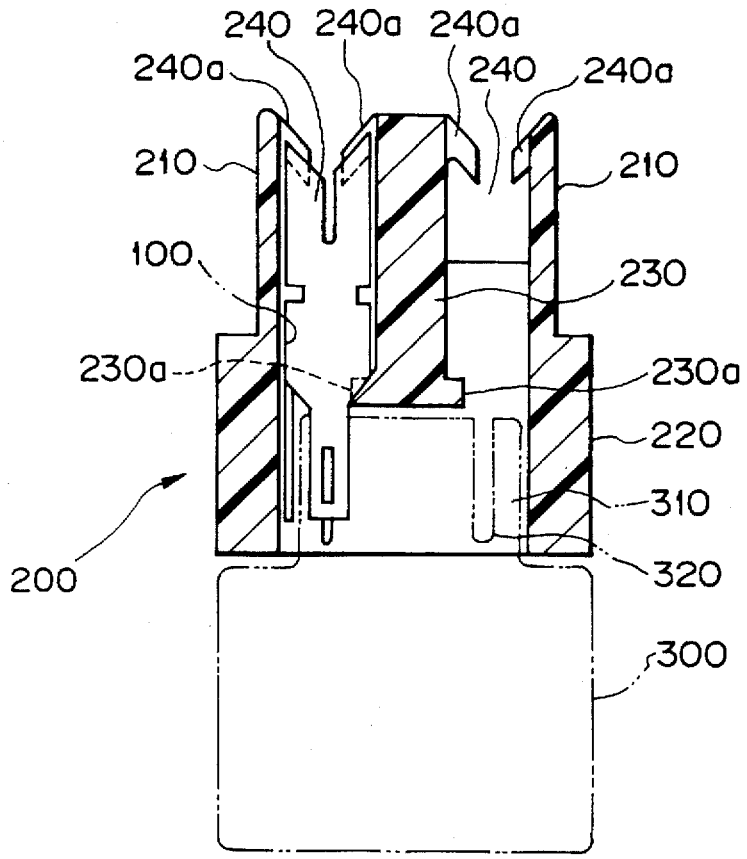
FIG. 21 is a cross sectional view of a casing.
Figure 22:
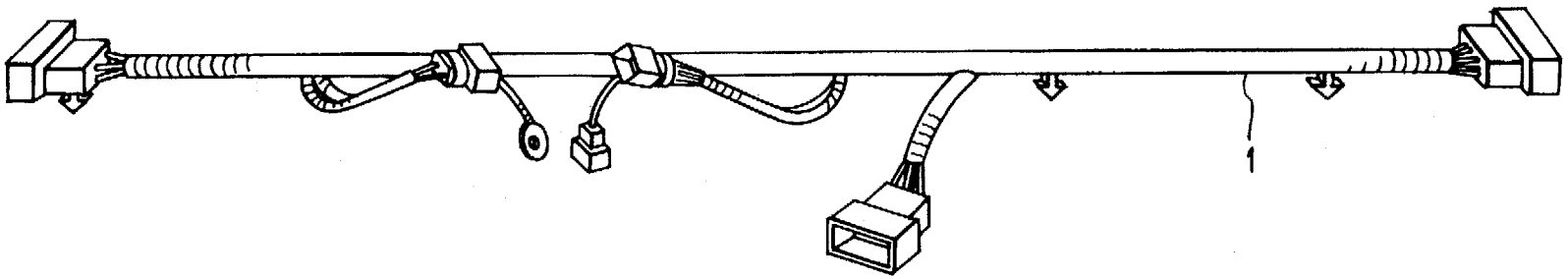
Fig. 22 PRIOR ART
FIG. 22 is a perspective view of a conventional wire harness.
Figure 23:
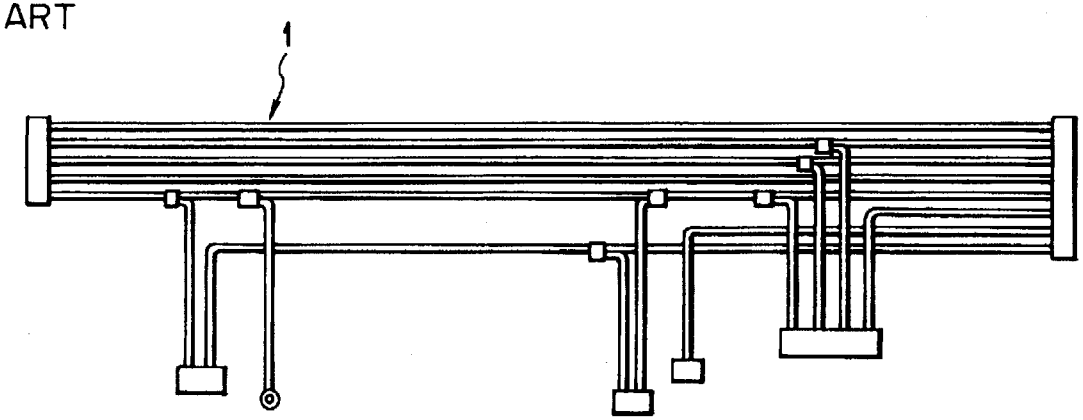
Fig. 23 PRIOR ART
FIG. 23 is a plan view of a conventional wire harness illustrating an example of branched electrical cables.
Figure 24:
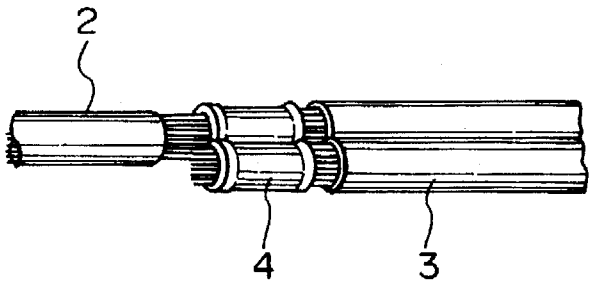
Fig. 24 PRIOR ART
FIG. 24 is a perspective view of the branched electrical cable.
Figure 25:
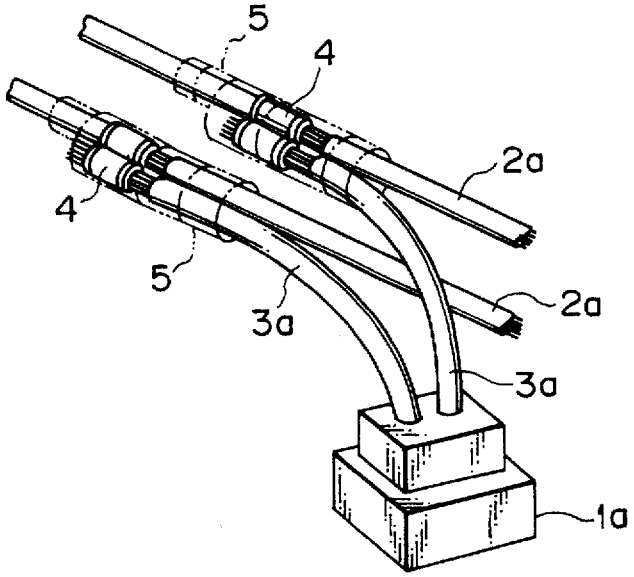
Fig. 25 PRIOR ART
FIG. 25 is a perspective view of a conventional socket joint for a lighting fixture, illustrating a connection between the joint and the harness.
Figure 26:
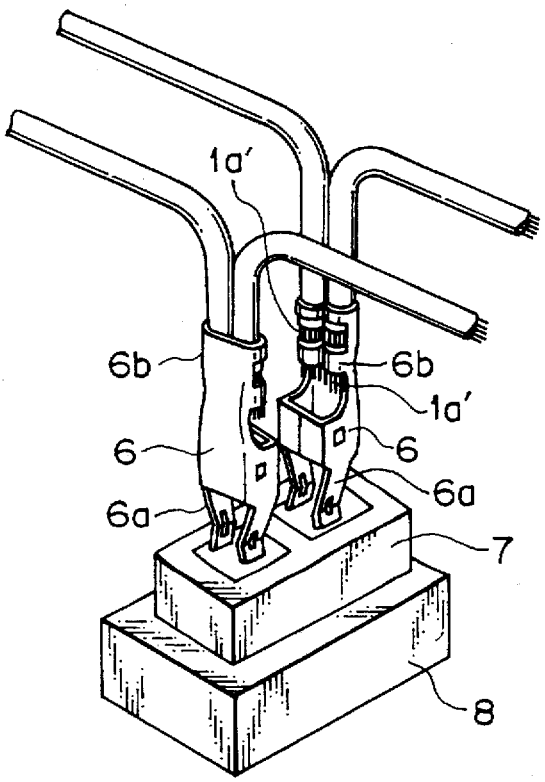
Fig. 26 PRIOR ART
FIG. 26 is a perspective view of another conventional socket Joint for a lighting fixture, illustrating a connection between the joint and the harness.

FIG. 21 shows a cross section of a casing 200. The casing 200 is provided at an upper end with cylindrical portions 210 and 210 which receive press-contact electrodes 100 individually and at a lower end with a hood 220 which receives an electrode 310 of a lighting fixture 300. A lower end of each cylindrical portion 210 is communicated with the hood 220. A partition 230 between the cylindrical portions 210 is provided at a lower end with projections 230*a* which extend toward the interiors of the cylindrical portions 210.

The cylindrical portions 210 are provided at upper walls opposed to the press-contact portion 120 of the electrode 100 with notches (guide portion) 240 into which the cables W can be inserted downwardly. Slant pieces 240*a* and 240*a* are formed on both sides of an inlet of the notch 240 so as to prevent the cable from slipping out of the notch 240.

A pair of lead lines (electrodes) 320 and 320 are extended from a lower face of an electrode part 310 of the lighting fixture 300 and bent on the opposite faces of the electrode part 310.

An operation of the fourth embodiment will be described below.

The casing 200 is positioned with the hood being directed downwardly and then the press-contact electrodes 100 are inserted downwardly into the cylindrical portions 210. At this time, the walls having the pieces 150 are oriented in opposite directions with each other in the portions. The projections 230*a* on the lower ends of the partitions 230 engage with lower end faces of the body 110 of the press-contact electrode 100 in the cylindrical portion 210 to prevent the electrode 100 from slipping out of the portion 210.

Then, the cables W are pushed into the notches 240. Since slant pieces 240*a* are formed on the inlets of the notches 240 and the upper ends 120a of the press-contact portions 120 are formed into slant faces, the cables W are pushed into the center of the portions 120 automatically. Since the press-contact portion 120 is provided at the center with the press-contact slot 130, the cable W is pushed into the press-contact slot 130 and the opposed metal edges of the slots 180 cut through the sheath, thereby electrically connecting the edges to the conductors.

On the other hand, the cable W is inserted Into the notch 240 while deflecting the slant pieces 240*a* outwardly. However, since the pieces 240*a* return to the original position after the cable W is completely inserted into the notch 240, the cable W can not slip out of the notch 240. Accordingly, the press-contact electrode 100 cannot move in the upper and lower directions and an assembly work of the lighting fixture is finished.

Finally, the electrode 310 of the lighting fixture 300 is inserted into the hood 220. When the electrode 310 is inserted into the hood 220, the electrode 310 spreads the terminal portions 140 and is inserted thereinto. At this time, one of the terminal portions 140 which clamp the electrode 310 contact with the lead line 320 bent on the side face of the electrode 310. Thus, an electrical power supply path from the pair of cables W to the lead line 820 is completed and the lighting fixture is conducted to turn a light on.

According to the press-contact connector assembly of the present invention, it is possible to prevent an unstable position of the branched line since the branched line is easily formed and is extracted in any desired direction, to simplify wiring work since the coupling face Is directed to the front side when it is disposed on an arranging position, to prevent projection of the branched line and arrange it in a narrow space since it can be arranged in parallel to the main line, and to effect all connections of the socket joint for the lighting fixture without using a special tool.

What is claimed is:

1. A press-contact connector assembly for a socket joint of a lighting fixture, comprising:

a press-contact electrode including a box-shaped body, a press-contact blade on one end of said box-shaped body, said press-contact blade having two opposed press-contact portions which extend away from said box-shaped body and form an axial slot therebetween for receiving a cable, each of said press-contact portions having an upper end which tapers inwardly toward said axial slot at an inclined angle, and a power supply terminal on the other end of said box-shaped body; and a casing including a hood for receiving a lighting fixture electrode, a cylindrical portion for holding said press-contact electrode so that said power supply terminal contacts with said lighting fixture electrode in said hood, and a guide portion for defining a guide path to introduce the cable into said axial slot of said press-contact blade, said guide portion comprising a notch at an upper portion of said cylindrical portion and which forms an inlet into which the cable is introduced, and slant portions formed on opposite sides of the inlet of said notch, each of said slant portions being directly adjacent to the upper end of a corresponding one of said press-contact portions and having an inclined angle which corresponds to the inclined angle of the upper end of the corresponding one of said press-contact portions of said press-contact blade, said slant portions serving to guide the cable into said axial slot, and said slant portions protruding inwardly and each having at least a part which extends below the upper end of the corresponding one of said press-contact portions and being shaped so as to retain the cable within said axial slot and preventing the cable from slipping out of said notch after passing therethrough.

* * * * *